US007954460B2

(12) United States Patent
Kimura et al.

(10) Patent No.: US 7,954,460 B2
(45) Date of Patent: Jun. 7, 2011

(54) BOILER APPARATUS

(75) Inventors: Hajime Kimura, Hiroshima (JP); Junichiro Matsuda, Hiroshima (JP)

(73) Assignee: Babcock-Hitachi Kabushiki Kaisha, Minato-ku, Tokyo (JP)

( * ) Notice: Subject to any disclaimer, the term of this patent is extended or adjusted under 35 U.S.C. 154(b) by 0 days.

(21) Appl. No.: 10/565,489

(22) PCT Filed: Jul. 22, 2004

(86) PCT No.: PCT/JP2004/010778

§ 371 (c)(1),
(2), (4) Date: Jan. 30, 2007

(87) PCT Pub. No.: WO2005/008129

PCT Pub. Date: Jan. 27, 2005

(65) Prior Publication Data

US 2007/0151525 A1 Jul. 5, 2007

(30) Foreign Application Priority Data

Jul. 22, 2003 (JP) ..... 2003-199854

(51) Int. Cl.
*F22D 7/00* (2006.01)

(52) U.S. Cl. ..... 122/235.15; 122/406.1; 122/406.3

(58) Field of Classification Search ..... 122/1 B, 122/1 C, 235.29, 235.11, 235.15, 493, 450, 122/496, 273, 277, 284, 406.1, 406.3
See application file for complete search history.

(56) References Cited

U.S. PATENT DOCUMENTS

| | | | | |
|---|---|---|---|---|
| 4,262,637 | A * | 4/1981 | Wiener | 122/478 |
| 4,953,509 | A * | 9/1990 | Klein | 122/6 A |
| 5,253,703 | A * | 10/1993 | Master et al. | 165/82 |
| 7,275,503 | B2 * | 10/2007 | Waseda et al. | 122/7 R |

FOREIGN PATENT DOCUMENTS

| | | |
|---|---|---|
| JP | 45-25921 | 8/1970 |
| JP | 56-27801 | 3/1981 |
| JP | 5-71607 | 9/1993 |
| JP | 11-351506 | 12/1999 |
| JP | 2001-033002 | 2/2001 |
| JP | 2001-324102 | 11/2001 |

* cited by examiner

*Primary Examiner* — Gregory A Wilson
(74) *Attorney, Agent, or Firm* — Crowell & Moring LLP

(57) ABSTRACT

A boiler apparatus for leading fluid from a plurality of upper walls (2) to (4) to a ceiling wall (7) through a ceiling wall inlet header (11), characterized in that a ceiling wall inlet mixing header (8) is installed between the plurality of upper walls (2) to (4) and the ceiling wall inlet header (11).

1 Claim, 6 Drawing Sheets

BOILER APPARATUS

FIELD OF THE INVENTION

The present invention relates to a boiler apparatus, and particularly relates to a boiler circuit (steam system configuration of boiler furnace).

BACKGROUND OF THE INVENTION

FIG. 6 shows the configuration of a background-art boiler furnace circuit. Boiler water introduced from an economizer runs into the following circuit. That is, the boil water passing through a spiral water wall 1 is distributed to upper wall side walls 2, an upper wall front wall 3, an upper screen pipe 4 and an upper nose wall 5. After that, the boiler waters passing through the upper wall side walls 2, the upper wall front wall 3 and the upper screen pipe 4 join one another in a ceiling wall 7 while the boiler water passing through the upper nose wall 5 is supplied to auxiliary side walls 6. In FIG. 6, the reference numeral 11 represents a ceiling wall inlet header, and 12 represents a furnace outlet connecting duct.

A rectangular parallelepiped boiler furnace structure is arranged so that a fluid channel is divided into channels corresponding to the respective furnace component surfaces (the upper wall side walls 2, the upper wall front wall 3, the upper screen pipe 4 and the upper nose wall 5), and those channels are linked with one another. Accordingly, it is inevitable that different circuits join one another in the inlet of the ceiling wall 7.

Chiefly in order to reduce temperature differences generated among the upper walls 2 to 4, the connecting ducts 12 between the upper walls 2 to 4 and the ceiling inlet header 11 are designed to be shuffled among the side walls 2, the front wall 3 and the upper screen pipe 4 as shown in FIG. 6, so as to reduce the temperature difference in the ceiling wall 7 caused by temperature differences of fluid among the respective portions.

The connecting ducts 12 are arranged thus to relax the temperature history of the fluid to the ceiling wall 7. Each connecting duct 12 is not always connected to the ceiling wall inlet header 11 close to the connecting duct 12 with a shortest distance. The connecting ducts 12 have a complicated layout as shown in FIG. 6.

Examples of known techniques of such boiler apparatus include JP-UM-A-5-71607, JP-A-2001-33002, etc.

In the background-art boiler apparatus, the connecting ducts 12 connected to the ceiling wall 7 are shuffled to relax the temperature difference in the ceiling wall 7. In fact, however, the temperature difference of fluid cannot be eliminated drastically.

FIG. 7 is a view showing a result of measurement of actual temperature distributions in the furnace wall outlet, the ceiling wall inlet and the ceiling wall outlet. The fluid temperature is high in a portion of the ceiling wall 7 where the connecting duct 12 connected to the front wall 3 is plugged. On the contrary, the fluid temperature is low in a portion of the ceiling wall 7 where the connecting duct 12 connected to each side wall 2 is plugged. Thus, the temperature difference in the inlet of the ceiling wall 7 is so large that the useful life of the ceiling wall 7 is short. Particularly in a transient phase, for example, when there is a variation in a load, when a furnace cleaner (soot blower) is operated, or when a burner is fired on/off, there is a problem that an expected temperature difference reduction effect cannot be obtained.

Further, there is also a disadvantage that the layout of the connecting ducts 12 is so complicated that a large space is required for the duct arrangement, and the working of installing the connecting ducts 12 is troublesome.

In order to solve the foregoing disadvantages belonging to the background art, an object of the present invention is to provide a boiler apparatus which can relieve the reduction of the useful life of a ceiling wall caused by a temperature difference in the ceiling wall and which can simplify the structure.

DISCLOSURE OF THE INVENTION

In order to attain the foregoing object, a first means of the present invention is a boiler apparatus for leading fluid from a plurality of upper walls to a ceiling wall through a ceiling wall inlet header, characterized in that a ceiling wall inlet mixing header is installed between the plurality of upper walls and the ceiling wall inlet header.

A second means of the present invention is a boiler apparatus according to the first means, characterized in that the plurality of upper walls are side walls, a front wall and a screen pipe.

A third means of the present invention is a boiler apparatus according to the first means, characterized in that a bent portion is provided in a part of the ceiling wall inlet mixing header.

A fourth means of the present invention is a boiler apparatus according to the third means, characterized in that the ceiling wall inlet mixing header is bent in an L-shape.

A fifth means of the present invention is a boiler apparatus according to the first means, characterized in that the ceiling wall inlet mixing header is installed substantially in a central portion in a furnace width direction, and mixing header outlet connecting ducts are arranged substantially symmetrically with respect to the ceiling wall inlet mixing header so as to connect the ceiling wall inlet mixing header with the ceiling wall inlet header.

According to the present invention, the temperature difference in the ceiling wall can be reduced. Thus, the ceiling wall can be prevented from being deformed due to the temperature difference, so that the useful life of the ceiling wall can be prolonged on a large scale.

BEST MODE FOR CARRYING OUT THE INVENTION

Figure 1:
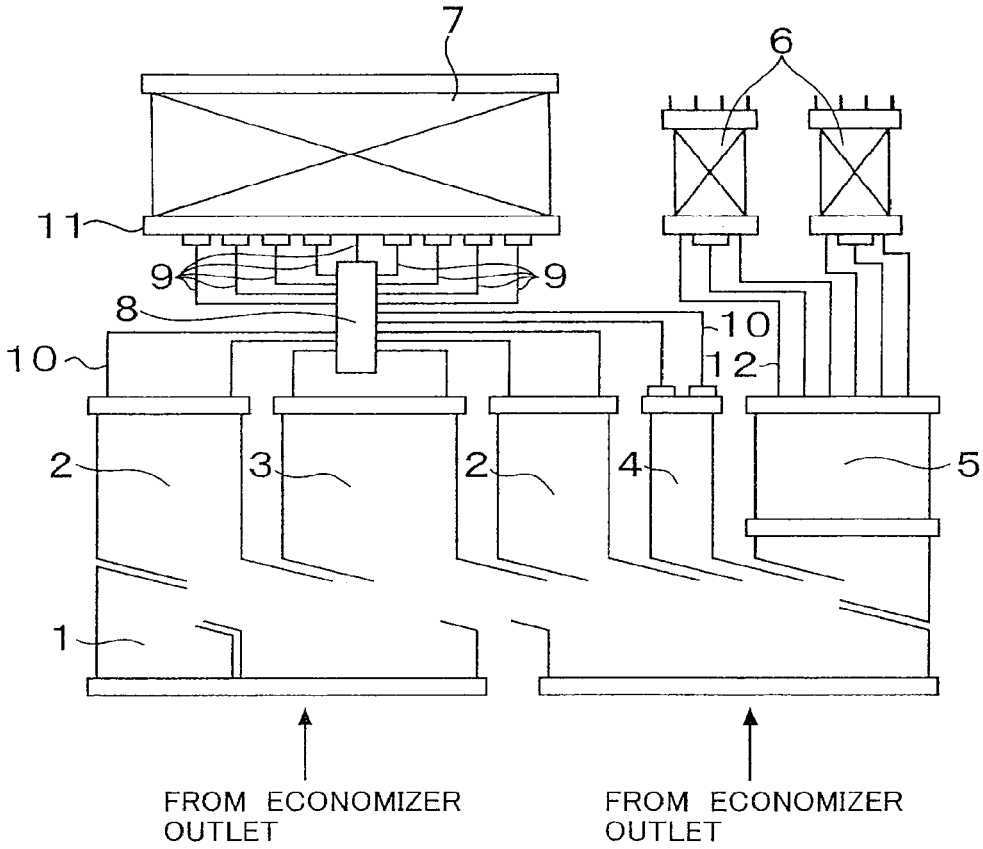
FIG. 1 is an explanatory schematic view of a circuit in a boiler furnace according to an embodiment of the present invention.
Figure 2:
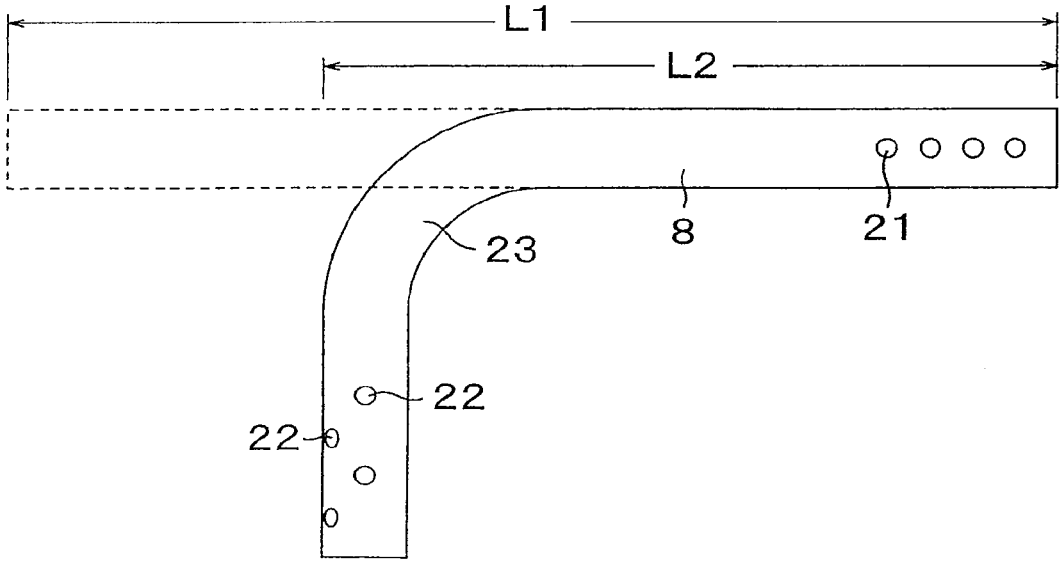
FIG. 2 is a side view of a ceiling wall inlet mixing header used in the circuit in the boiler furnace.
Figure 3:
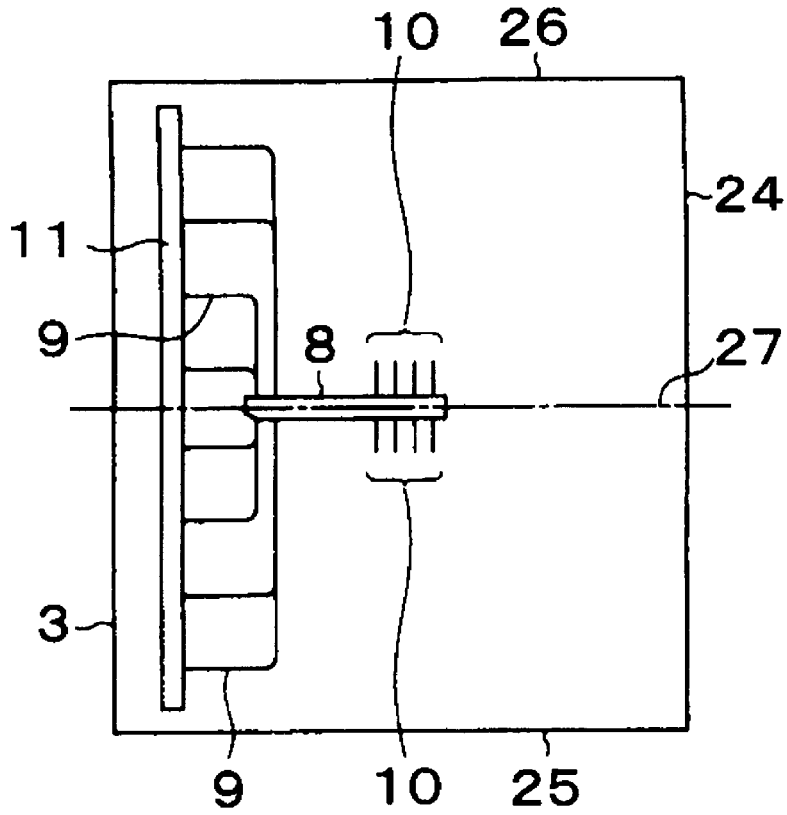
FIG. 3 is an explanatory schematic view showing the layout of the ceiling wall inlet mixing header and the duct arrangement of mixing header outlet connecting ducts in a boiler body.
Figure 4:
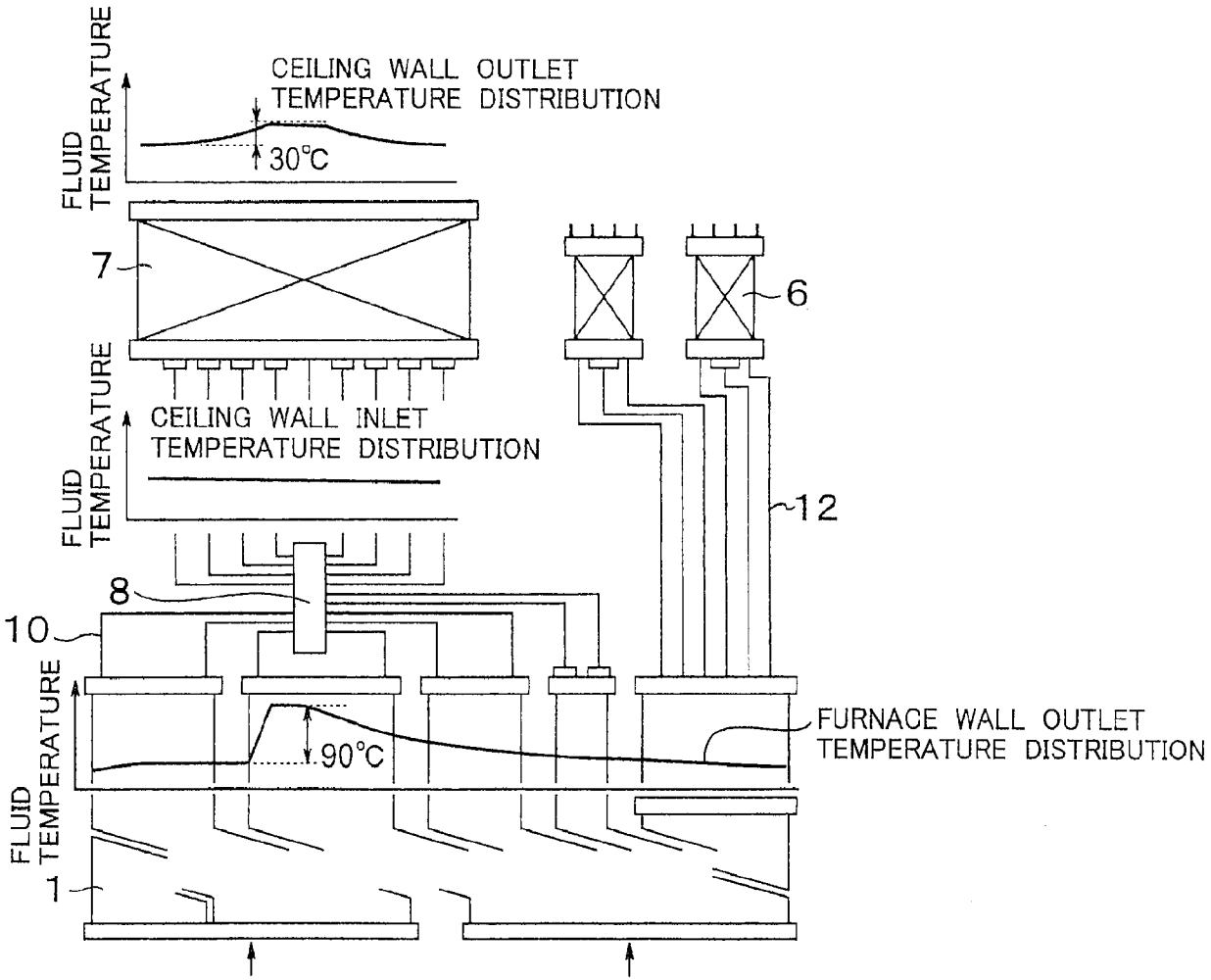
FIG. 4 is a view showing a result of measurement of temperature distributions in a furnace wall outlet, a ceiling wall inlet and a ceiling wall outlet of a boiler apparatus according to the embodiment of the present invention.

Next, an embodiment of the present invention will be described with reference to the drawings. FIG. 1 is an explanatory schematic view of a circuit in a boiler furnace according to the embodiment; FIG. 2 is a side view of a ceiling wall inlet mixing header used in the circuit in the boiler furnace; FIG. 3 is an explanatory schematic view showing the layout of the ceiling wall inlet mixing header and the duct arrangement of mixing header outlet connecting ducts in a boiler body; and FIG. 4 is a view showing a result of measurement of temperature distributions in a furnace wall outlet, a ceiling wall inlet and a ceiling wall outlet.

Figure 5:
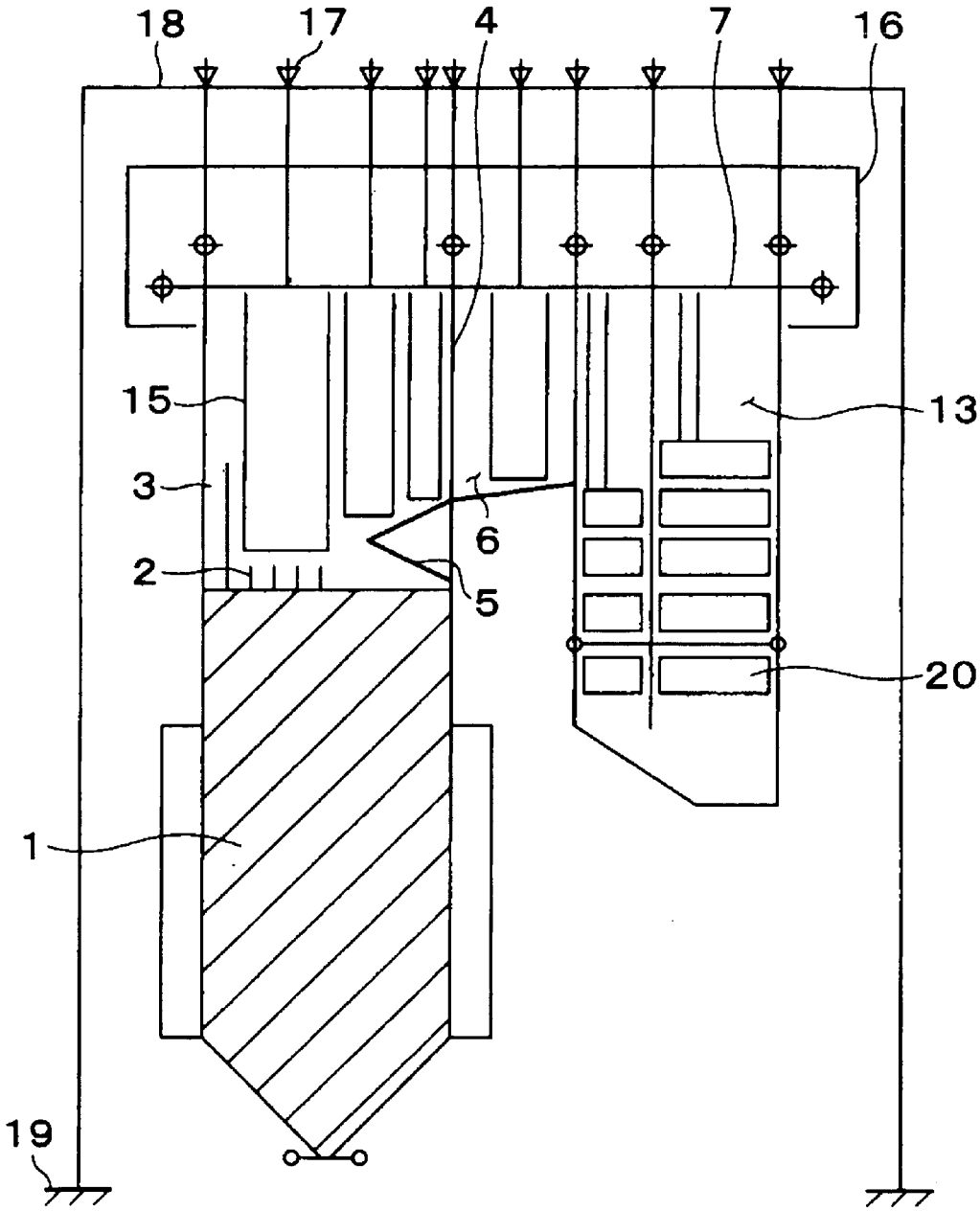
FIG. 5 is a schematic configuration view of the boiler apparatus as a whole.
Figure 6:
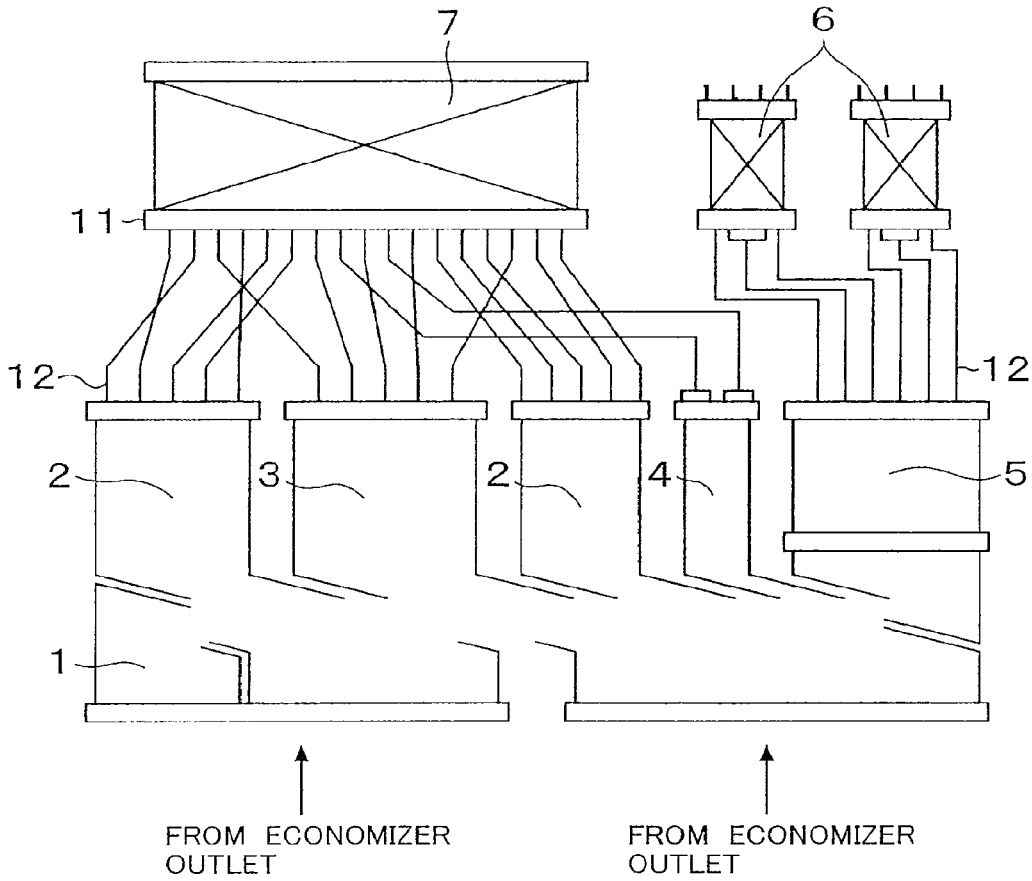
FIG. 6 PRIOR ART
FIG. 6 is an explanatory schematic view of a circuit in a boiler furnace in a background-art boiler apparatus.

FIG. 5 is a schematic configuration view of the boiler apparatus as a whole. The boiler body is chiefly constituted by a spiral water wall 1, upper wall side walls 2, an upper wall front wall 3, an upper screen pipe 4, an upper nose wall 5, auxiliary side walls 6, a ceiling wall 7, a cage wall 13, various suspended heat exchanger tubes 15 disposed in the furnace, etc. The portion above the ceiling wall 7 is partitioned by a penthouse casing 16.

The boiler body is supported on a top boiler steel frame 18 indispensably through spring bolts 17. The boiler body is designed to extend downward (to the ground 19) because the boiler body reaches a high temperature in operation.

The circuit in the boiler furnace according to the embodiment will be described with reference to FIG. 1. Boiler water introduced from an economizer 20 (see FIG. 5) passes through the spiral wall 1, and is then distributed to the upper wall side walls 2, the upper wall front wall 3, the screen pipe 4 and the nose wall 5. The upper wall side walls 2, the upper wall front wall 3 and the screen pipe 4 are connected to one end of a ceiling wall inlet mixing header 8 through mixing header inlet connecting ducts 10. The ceiling wall inlet mixing header 8 is connected to a ceiling wall inlet header 11 through mixing header outlet connecting ducts 9.

As shown in FIG. 2, the ceiling wall inlet mixing header 8 has a lateral shape bent into a substantially L-shape, and the opposite open ends thereof are closed. When a bent portion 23 is provided thus like an L-shape halfway in the ceiling wall inlet mixing header 8, length L2 occupied by the ceiling wall inlet mixing header 8 can be made substantially shorter than length L1 which would be occupied by the ceiling wall inlet mixing header 8 if it were extended like a straight line, while the length of the fluid mixer region is substantially kept as it is. Thus, the apparatus can be made compact. In addition, when the bent portion 23 is provided halfway in the ceiling wall inlet mixing header 8, the flow of fluid can be changed so that fluid mixing can be performed satisfactorily.

One end of the ceiling wall inlet mixing header 8 is bent downward in the embodiment. However, one end of the ceiling wall inlet mixing header 8 may be bent horizontally so that the ceiling wall inlet mixing header 8 can be formed into an L-shape. Alternatively, the ceiling wall inlet mixing header 8 may be bent vertically or horizontally into a U-shape.

A plurality of holes 21 to be connected to the mixing header inlet connecting ducts 10 are formed near one end portion of the ceiling wall inlet mixing header 8 while a plurality of holes 22 to be connected to the mixing header outlet connecting ducts 9 are formed near the other end portion of the ceiling wall inlet mixing header 8. The holes 21 to be connected to the mixing header inlet connecting ducts 10 where fluid different in temperature will be introduced are formed substantially on one and the same line as shown in FIG. 2.

As shown in FIG. 3, the ceiling wall inlet mixing header 8 is installed on a center line 27 between a right wall 25 and a left wall 26 in a boiler body 24, that is, in a central portion in the width direction of the furnace. The side of the ceiling wall inlet mixing header 8 where the holes 22 (see FIG. 2) to be connected to the mixing header outlet connecting ducts 9 are formed faces the ceiling wall inlet header 11 installed on the front wall 3 side of the boiler body 24. The plural (eight in this embodiment) mixing header outlet connecting ducts 9 extending from the ceiling wall inlet mixing header 8 are arranged substantially symmetrically with respect to the ceiling wall inlet mixing header 8 in view from the plane of the boiler body 24, and connected to the ceiling wall inlet header 11 substantially at regular intervals.

The upper wall side walls 2, the upper wall front wall 3 and the screen pipe 4 form different furnace walls respectively as described above. Accordingly, the upper wall side walls 2, the upper wall front wall 3 and the screen pipe 4 have different heat absorption histories in accordance with conditions as to a variation of the load, management of the furnace cleaner, firing on/off the burner, etc. As a result, different fluid temperatures appear in the outlets of those portions respectively.

The connecting ducts 10 from the respective portions are connected to the ceiling wall inlet mixing header 8 installed on the inlet side of the ceiling wall 7. Fluid from the respective portions is mixed uniformly in the ceiling wall inlet mixing header 8. The mixing header outlet connecting ducts 9 are installed in positions where enough distances from the connection points with the mixing header inlet connecting ducts 10 can be secured to attain perfect mixing. Thus, the fluid temperature to the inlet of the ceiling wall 7 can be made uniform. Since the fluid temperature is uniform, it is not necessary to give a consideration such as shuffling the connecting ducts between the left and right of the boiler as in the background art. Thus, the connecting ducts 9 can be disposed symmetrically with shortest distances to the boiler ceiling wall inlet header 11 close thereto.

FIG. 4 shows temperature distributions in the furnace wall outlet, the ceiling wall inlet and the ceiling wall outlet when a heat load on the central portion of the furnace is high, and the heat absorption of the front wall of the furnace increases extremely (resulting in a temperature difference of 90° C. as to the furnace outlet fluid temperature).

Figure 7:
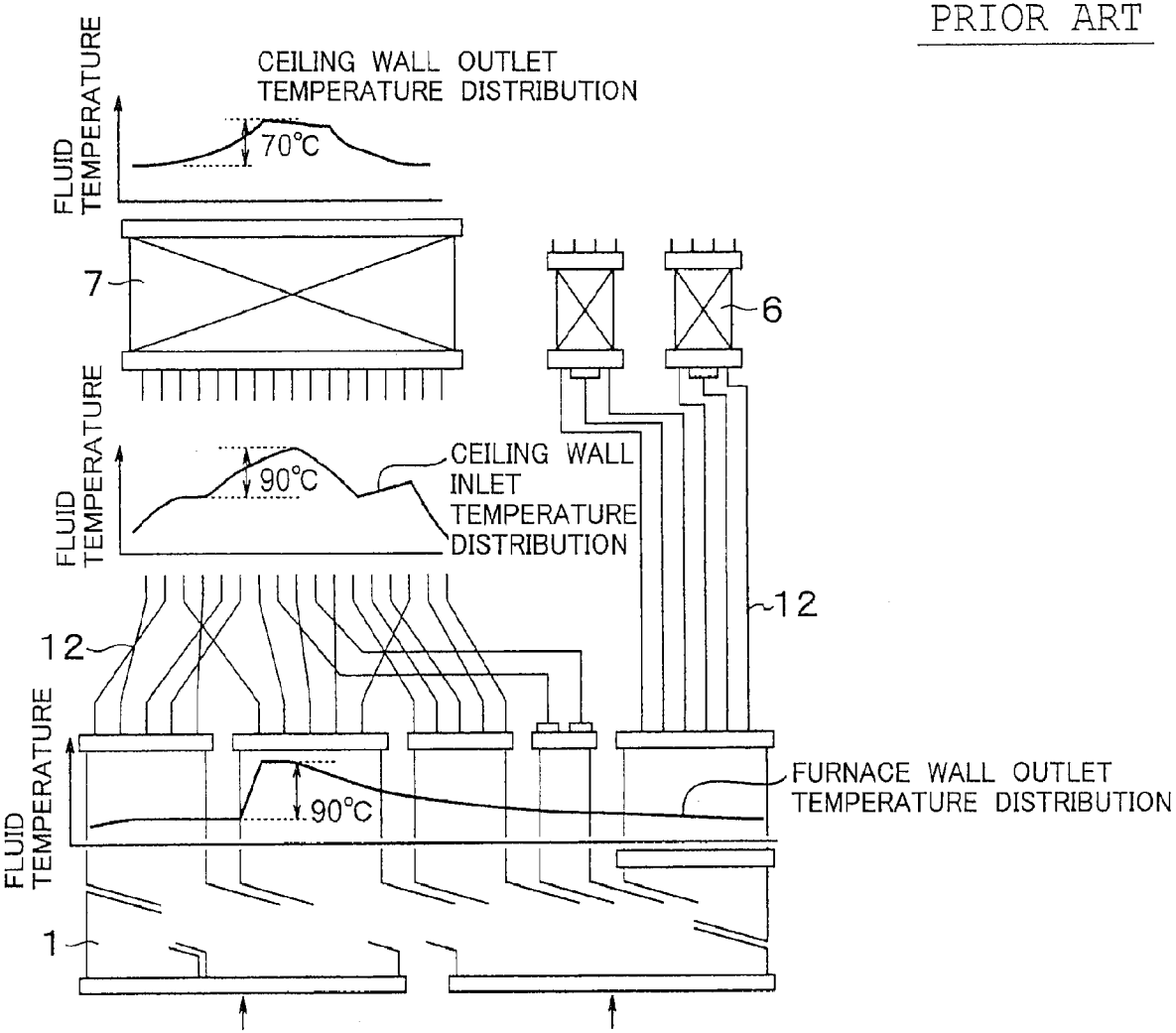
FIG. 7 PRIOR ART
FIG. 7 is a view showing a result of measurement of temperature distributions in a furnace wall outlet, a ceiling wall inlet and a ceiling wall outlet of the background-art boiler apparatus.

When the mixing header 8 is installed, the ceiling wall inlet temperature can be made substantially uniform as compared with that in the case where the temperature history in the ceiling wall inlet is inherited in the background art shown in FIG. 7, where there is no mixing header. Thus, the ceiling wall outlet temperature difference can be reduced to 30° C. or lower. When the ceiling wall outlet temperature difference is 30° C., the allowable number of cycles of the bent tube portion forming the ceiling wall 7 reaches about 1.2×105 cycles. Thus, the useful life of the ceiling wall 7 can be prolonged on a large scale.

The outlet connecting ducts 12 connected to the nose wall 5 in FIG. 1 may be connected to the ceiling wall 7 (ceiling wall inlet mixing header 8). However, the nose wall 5 is high in heat absorption because the nose wall 5 projects into the furnace as shown in FIG. 5. The fluid coming from the nose wall 5 is so high in temperature that it does not have to be absolutely introduced into the ceiling wall 7 so as to be heated again. When the fluid coming from the nose wall 5 is mixed into the ceiling wall 7, there may arise adverse effects. For example, the ceiling wall outlet temperature difference may be increased, or the flow rate may be increased so that the diameter of the heat exchanger tube forming the ceiling wall 7 must be increased. In this embodiment, therefore, the fluid coming from the nose wall 5 is introduced into the auxiliary side walls 6 through the outlet connecting ducts 12.

Though not shown, fluid coming from the auxiliary side walls 6 and the ceiling wall 7 is introduced into a water separator so as to be separated into water and steam.

The invention claimed is:

1. A boiler apparatus for leading fluid from a plurality of upper walls to a ceiling wall through a ceiling wall inlet header, comprising:

a ceiling wall inlet mixing header is installed between the plurality of upper walls and the ceiling wall inlet header;

wherein the plurality of upper walls includes side walls, a front wall, and a screen pipe, and does not include a nose wall projecting into a boiler furnace;

wherein the ceiling wall inlet mixing header with opposite open ends being closed has a bent portion halfway thereof which forms the ceiling wall inlet mixing header in an L-shape and wherein the ceiling wall inlet mixing header is installed substantially in a central portion in a furnace width direction;

a plurality of first holes formed near a first end portion of the ceiling wall inlet mixing header substantially on a same line along an axis of the ceiling wall inlet mixing header;

a plurality of second holes formed near a second end portion of the ceiling wall inlet mixing header, wherein the second end portion is bent downward with respect to the first end portion;

mixing header inlet connecting ducts connected to the side walls, the front wall, and the screen pipe, respectively, wherein the mixing header inlet connecting ducts are connected to the first holes formed near the first end portion of the ceiling wall inlet mixing header; and mixing header outlet connecting ducts extending to the ceiling wall inlet header, wherein the mixing header outlet connecting ducts are connected to the second holes formed near the second end portion of the ceiling wall inlet mixing header.

* * * * *